US007077362B2

(12) United States Patent
Edelmeier

(10) Patent No.: US 7,077,362 B2
(45) Date of Patent: Jul. 18, 2006

(54) SIEVE TRAY FOR A SIEVE DEVICE

(75) Inventor: Friedrich Edelmeier, Beckum (DE)

(73) Assignee: Haver & Boecker, Oelde (DE)

( * ) Notice: Subject to any disclaimer, the term of this patent is extended or adjusted under 35 U.S.C. 154(b) by 224 days.

(21) Appl. No.: 10/453,581

(22) Filed: Jun. 4, 2003

(65) Prior Publication Data

US 2003/0226938 A1 Dec. 11, 2003

(30) Foreign Application Priority Data

Jun. 6, 2002 (DE) ..... 202 08 865 U

(51) Int. Cl.
*B21F 27/00* (2006.01)

(52) U.S. Cl. ..... 245/1; 245/2

(58) Field of Classification Search ..... 245/1, 245/2, 4, 9–11, 8; 139/383 AA, 425 R, 425 A
See application file for complete search history.

(56) References Cited

U.S. PATENT DOCUMENTS

| | | | | | |
|---|---|---|---|---|---|
| 316,615 | A | * | 4/1885 | Gilbert | 427/156 |
| 375,321 | A | * | 12/1887 | Guilleaume | 15/241 |
| 2,696,847 | A | * | 12/1954 | Ernest et al. | 139/420 R |
| 3,146,801 | A | * | 9/1964 | Wilson | 139/425 A |
| 4,063,998 | A | * | 12/1977 | Henke | 162/348 |
| 4,564,051 | A | * | 1/1986 | Odenthal | 139/425 A |
| 4,691,744 | A | * | 9/1987 | Haver et al. | 139/425 R |
| 5,377,722 | A | * | 1/1995 | Jaala | 139/383 AA |

FOREIGN PATENT DOCUMENTS

DE 101 00 904 * 7/2002

* cited by examiner

*Primary Examiner*—Gary L. Welch
(74) *Attorney, Agent, or Firm*—Barnes & Thornburg LLP

(57) ABSTRACT

A sieve tray for a sieve device that includes at least one sieve netting. The sieve netting includes wire netting having warp and weft wires mutually connected in a weave. The weave has mutually spaced alternating crossings extending diagonally with respect to the warp and weft wires.

12 Claims, 3 Drawing Sheets

SIEVE TRAY FOR A SIEVE DEVICE

CROSS-REFERENCE

This non-provisional application claims benefit of German Application Number 1889 24344DE filed on Jun. 6, 2002, which disclosure is hereby incorporated by reference herein.

BACKGROUND AND SUMMARY OF THE INVENTION

The present invention relates to sieve trays for a sieve devices. These sieve trays usually have at least one sieve netting consisting of a wire netting, and each wire netting contains warp and weft wires mutually connected by a weave.

The above-referenced sieve trays are known in many constructions. Each sieve tray has an upper sieve netting, relative to an installed position, and a supporting netting, situated below, which has a larger mesh size. The mesh sizes of the sieve nettings depend on the sizes of the particles to be sieved. The sieve trays normally have a round or square design. Frequently, the sieve trays are also provided with tensioning edges in order to tension the sieve netting either transversely to the flow direction of the material or in the longitudinal direction of the material. The so-called tensioning edges are also known in various constructions. In order to separate particles from a material such as a liquid, an emulsion, or the like, two different methods are known. There is sieving by a sieve device or filtering by a filter device. For the sieving, the above-mentioned sieve tray can be used which, by a vibration generator, is caused to carry out a swinging motion.

In the case of the above-mentioned sieve trays, the wire netting may consist exclusively of warp wires and weft wires which extend at a right angle thereto. As a result, square meshes or openings are created in the projection. Such sieve trays have been very successful but are not completely satisfactory for certain applications, such as the sieving of particles of a certain size from an emulsion.

An aspect of the present invention is having a sieve tray configured such that particles of a certain size can be sieved out of a material, such as a liquid, an emulsion or the like.

This aspect, at least, is addressed by having sieve netting that is provided with mutually spaced alternating crossings situated diagonally to warp and weft wires.

The size of meshes or openings are no longer necessarily determined by spaces between the warp and weft wires but gores are formed which are no longer square. The size of the gores is a function of the positions of the alternating crossings with respect to the warp and weft wires. The warp and weft wires may be in contact with one another in a twill-lace weave. The alternating crossings additionally contribute to stabilization of the sieve netting because they also include wires.

In a preferred embodiment, the alternating crossings extend in a zigzag shape from one edge to the opposite edge. The alternating crossings extend from the edges which extend parallel and at a distance from the warp wires. The zigzag-shaped course of the alternating crossings additionally increases the stability, so that the service life of a sieve tray can be extended. So that a uniform mesh size is achieved over the entire sieve surface, each straight-lined section of the alternating crossings extends over a constant number of warp wires. In a preferred embodiment, in which the warp wires and the weft wires are situated at equal mutual distances and therefore form square meshes, the straight-lined sections of the alternating crossings also extend over the same number of weft wires as warp wires. The individual straight-lined sections of the alternating crossings will then be situated at an angle of 45° with respect to the warp and weft wires. In a preferred embodiment, the straight-lined sections of the alternating weft wires maximally extend, for example, over 20 warp wires.

In a preferred embodiment, the weaves of the warp and weft wires are zz-weaves. As a result, favorable conditions are obtained for the weaves of the alternating crossings. In a preferred embodiment, a side change of the warp wires takes place when they have skipped a certain number of weft wires, and this number corresponds to the warp wires skipped by the weft wires. In a preferred embodiment, the number of skipped warp wires amounts to two. The respective sections of the warp and the weft threads situated on one side are offset from one warp wire to the next warp wire by one weft wire. The sections of the weft wires situated on one side are also offset with respect to one another by one warp wire from one weft wire to the next.

Depending on the construction, the diameters of the warp wires 14 and the weft wires 15 may be the same as or coincide or approximately coincide, but may also be different. The diameters of the alternating crossings may coincide with or be the same as the diameters of the warp wires and, if the diameters of the weft wires deviate therefrom, may also coincide with or be the same as the diameters of the weft wires or approximately coincide. However, constructions are also conceivable in which the diameters of the alternating crossings deviate from the diameters of the warp wires as well as of the weft wires. Depending on an application's purpose, a supporting netting also can be functionally assigned to the sieve netting. The mesh width of this supporting netting is normally larger than that of the sieve netting.

The sieve trays are considered to be fine-meshed. So that a uniform tension is ensured along the entire width or the entire length, the sieve tray is equipped with one tensioning edge respectively on two mutually opposite sides, which tensioning edge is formed by shaping. As an alternative, the sieve netting may also be clamped onto a frame. For compensating tension differences in the sieve netting, a flexible element, preferably a plastic element, may be worked into at least one tensioning edge.

The invention will be better understood and appreciated from the following detailed descriptions and with reference to the accompanying drawings.

DETAILED DESCRIPTION OF THE PREFERRED EMBODIMENTS

Figure 1:
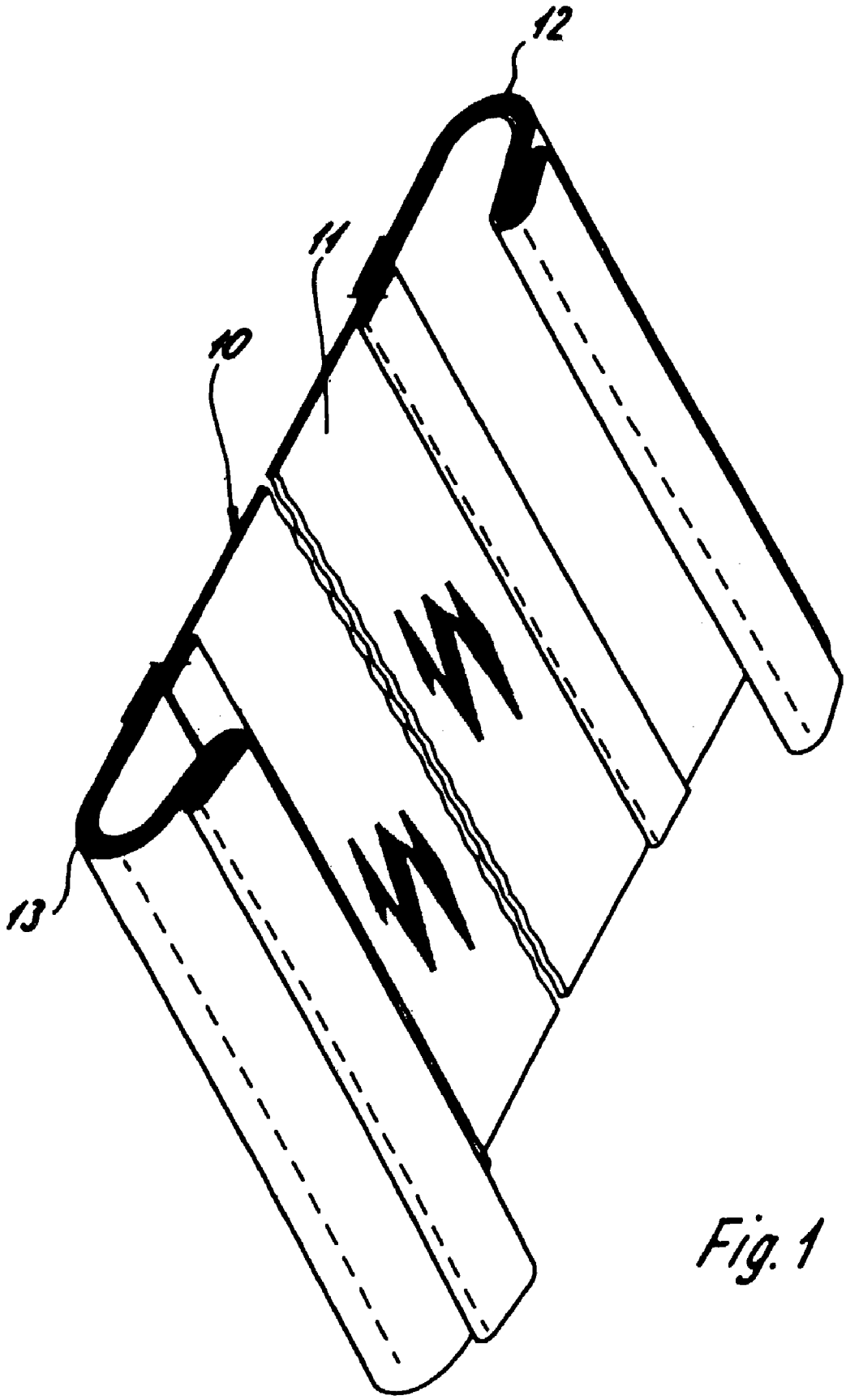
FIG. 1 is a perspective view of a sieve tray, according to the principles of the present invention.

FIG. 1 shows an embodiment of a sieve tray 10 having a sieve netting 11. On two mutually opposite sides, the sieve tray 10 is provided with one tensioning edge 12,13 respectively, with each being of an essentially U-shaped design and essentially facing each other. Free end areas of the tensioning edges 12, 13 are bent in opposite directions and each contacts an area of it's own tensioning edge 12, 13, respectively. Optionally, flexible plastic elements (not shown) can be worked into each tensioning edge 12, 13 in order to absorb tension differences in the sieve netting 11. As shown in FIG. 1, the tensioning edges 12, 13 are provided on shorter sides of the tray 10. In contrast to this construction, the tensioning edges 12, 13 may be shaped onto the longer sides (not shown).

Figure 2:
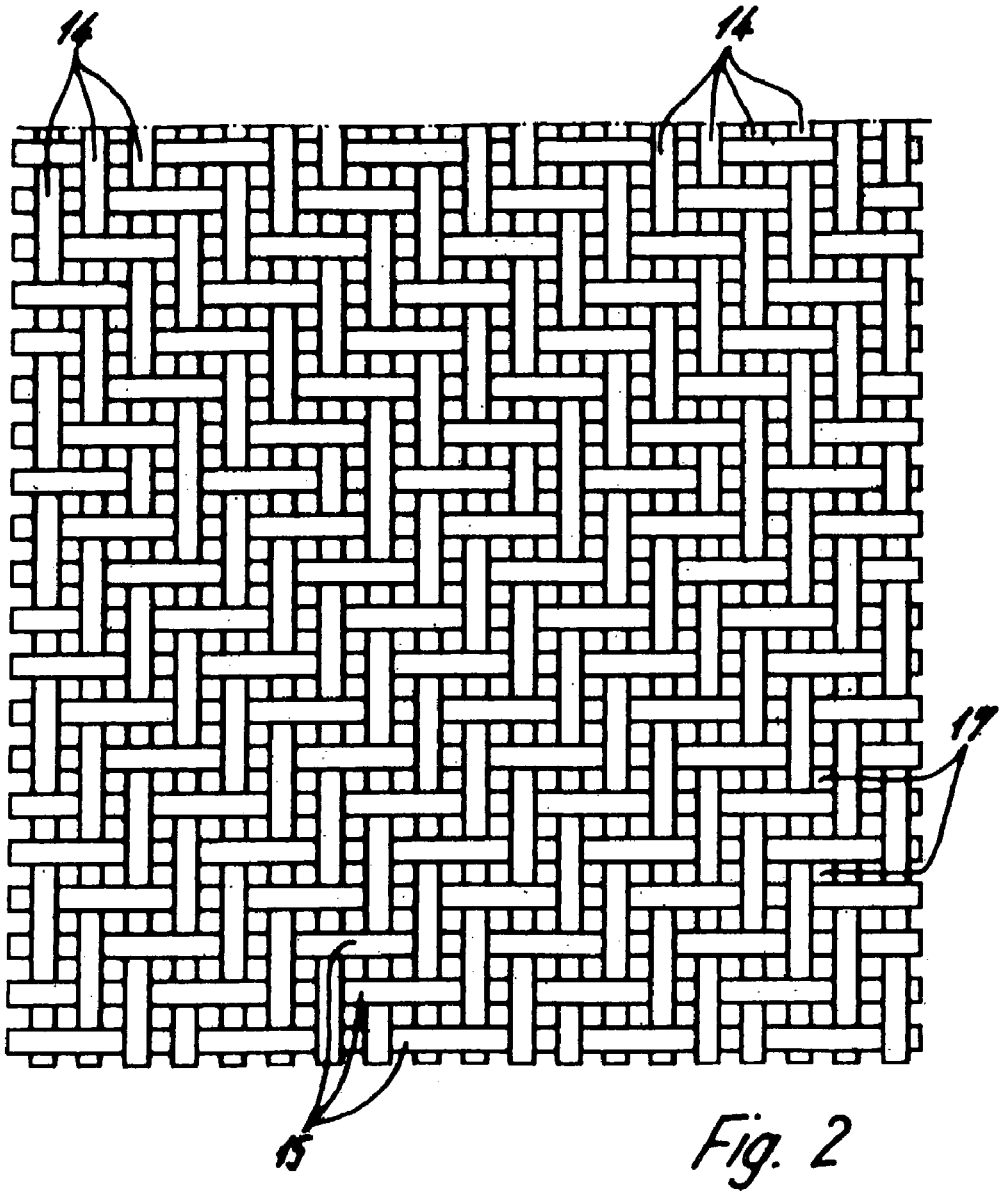
FIG. 2 is a top view of a starting product of a wire netting of a sieve tray, according to the principles of the present invention.

FIG. 2 shows a starting product of the sieve netting 11 of FIG. 1, which is formed of warp threads or wires 14 and of weft threads or wires 15. The warp wires 14 and the weft wires 15 are interwoven in a zz-weave. A wire netting 11 as shown in FIG. 2, is considered to be an example in which warp threads 14 and the weft threads 15 are arranged at a same mutual spacing so that square meshes 17 are obtained. In the embodiment of FIG. 2, a side change of the warp thread 14 takes place when the warp threads 14 have skipped two weft threads 15. The side change of the weft threads 15 takes place in a similar manner; that is, when two warp threads 14 have been skipped. FIG. 2 also shows that the side change of the warp threads 14 and of the weft threads 15 of two successive wires 14 or 15 is, in each case, offset by one wire 14 or 15, respectively.

Figure 3:
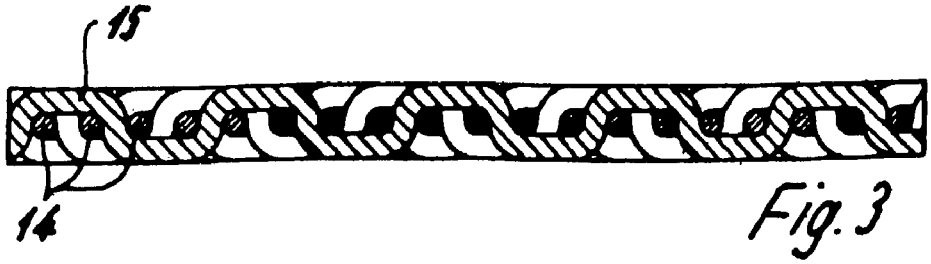
FIG. 3 is a sectional view of a weft wire and warp wires of the wire netting of FIG. 2.

FIG. 3 shows a cross-sectional view of a weft wire interwoven with warp wires 14.

Figure 4:
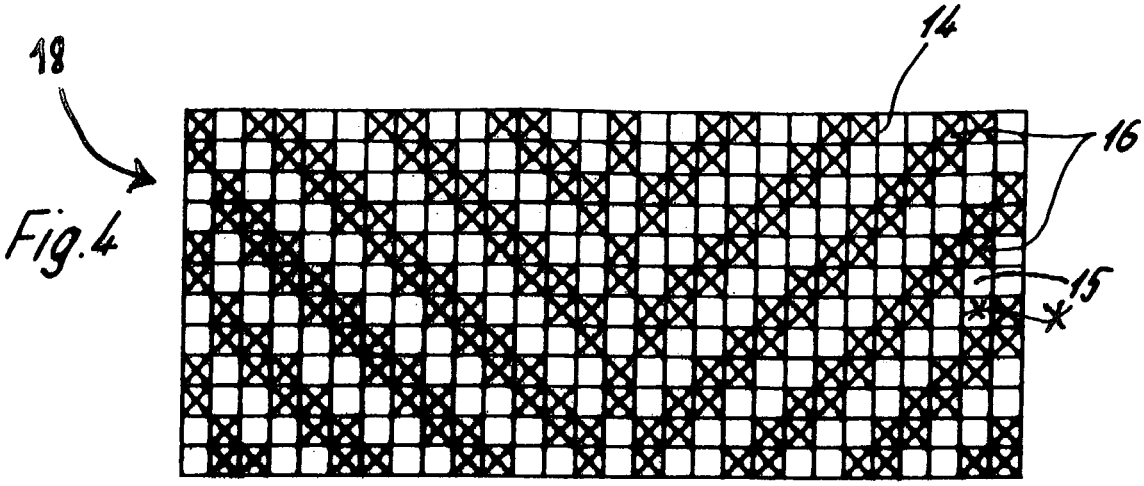
FIGS. 4–6 are dobby cards in three different embodiments, according to the principles of the present invention.
Figure 5:
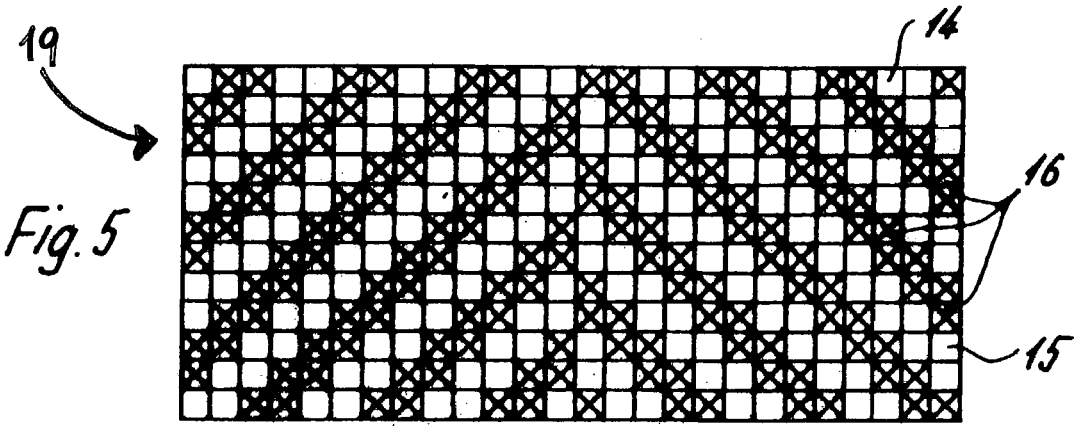
Figure 6:
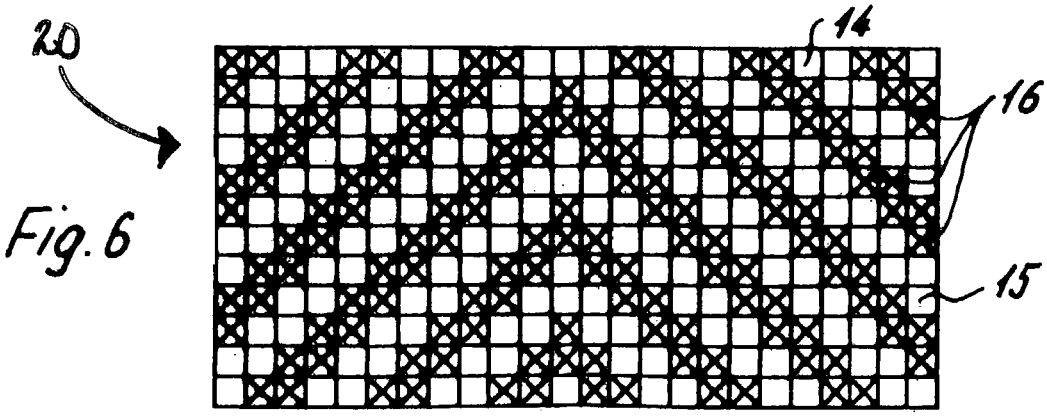

FIGS. 4–6 show dobby cards representing embodiments of wire nettings 18–20 of FIG. 2 that are equipped with alternating crossings 16 situated diagonally with respect to the warp wires 14 and the weft wires 15. The alternating crossings 16 extend at an angle of 45° with respect to the warp wires and to the weft wires 15. Spacing of the alternating crossings 16 is equal to two warp wires 14 and two weft wires 15 respectively. As a result, a fishbone-type pattern of the sieve netting 11 of FIG. 2 is obtained. FIGS. 4 to 6 show that the alternating crossings 16 extend in a zigzag shape. Each straight-line area to a change maximally skips, for example, 20 warp threads 14. In the embodiments of FIGS. 4–6, the alternating crossings 16 have the same diameter as the warp wires 14 and the weft wires 15. However, mutually deviating or different diameters are also conceivable.

The present invention is not limited to the embodiments described and shown herein. Other embodiments are possible that also have the sieve netting 11 equipped with alternating crossings 16 extending diagonally to the warp wires 14 and the weft wires 15.

Although the present disclosure has been described and illustrated in detail, it is to be clearly understood that this is done by way of illustration and example only and is not to be taken by way of limitation. The spirit and scope of the present disclosure are to be limited only by the terms of the appended claims.

What is claimed is:

1. A sieve tray for a sieve device, comprising:

at least one sieve netting that includes wire netting having warp and weft wires mutually connected in a weave, and having mutually spaced alternating crossings extending diagonally with respect to the warp and weft wires, and wherein the sieve tray further includes two mutually opposite sides with tensioning edges formed by shaping.

2. The sieve tray according to claim 1, wherein the alternating crossings extend in a zigzag shape, and each straight-line section of the alternate crossings extends over a constant number of warp wires.

3. The sieve tray according to claim 2, wherein each straight-line section of each alternating crossings extends maximally over 20 warp wires.

4. The sieve tray according to claim 1, wherein the weave of the warp and weft wires is a zz-weave.

5. The sieve tray according to claim 1, wherein a side change of the warp wires and of the weft wires takes place after a skipping of a constant number of weft and warp wires, respectively.

6. The sieve tray according to claim 1, wherein diameters of the warp wires and of the weft wires are approximately the same.

7. The sieve tray according to claim 1, wherein diameters of the warp wires and of the weft wires are different.

8. The sieve tray according to claim 1, wherein the alternating crossings extend at an angle of 45° with respect to the warp wires and the weft wires.

9. The sieve tray according to claim 1, wherein for an absorption of tension differences of the sieve netting, flexible elements are included in at least one tensioning edge.

10. The sieve tray according to claim 9, wherein the flexible elements are plastic elements.

11. A sieve tray for a sieve device, comprising:

at least one sieve netting that includes wire netting having warp and weft wires mutually connected in a weave, and having mutually spaced alternating crossings extending diagonally with respect to the warp and weft wires, and wherein a supporting netting is assigned to the sieve netting.

12. A sieve tray for a sieve device, comprising:

at least one sieve netting that includes wire netting having warp and weft wires mutually connected in a weave, and having mutually spaced alternating crossings extending diagonally with respect to the warp and weft wires, and wherein the sieve tray further includes two mutually opposite sides with tensioning edges formed by the sieve netting being clamped onto a frame.

* * * * *